US006996878B2

(12) United States Patent
Maidel et al.

(10) Patent No.: US 6,996,878 B2
(45) Date of Patent: Feb. 14, 2006

(54) DEVICE SUCH AS A CARDING MACHINE FOR PROCESSING FIBRES

(75) Inventors: Hermann Maidel, Reutlingen (DE); Peter Artzt, Reutlingen (DE); Volker Jehle, Ebersbach an der Fils (DE); Bernhard Bocht, Neubulach (DE)

(73) Assignee: Hollingsworth GmbH, Neubulach (DE)

( * ) Notice: Subject to any disclaimer, the term of this patent is extended or adjusted under 35 U.S.C. 154(b) by 244 days.

(21) Appl. No.: 10/363,022

(22) PCT Filed: Aug. 7, 2001

(86) PCT No.: PCT/EP01/09130

§ 371 (c)(1),
(2), (4) Date: Jun. 6, 2003

(87) PCT Pub. No.: WO02/18683

PCT Pub. Date: Mar. 7, 2002

(65) Prior Publication Data

US 2004/0010890 A1 Jan. 22, 2004

(30) Foreign Application Priority Data

Aug. 28, 2000 (DE) ..... 100 42 205

(51) Int. Cl.
*D01G 15/84* (2006.01)

(52) U.S. Cl. ..... 19/114

(58) Field of Classification Search ..... 19/98, 19/104, 110, 113, 114
See application file for complete search history.

(56) References Cited

U.S. PATENT DOCUMENTS

| | | | | |
|---|---|---|---|---|
| 4,606,095 | A * | 8/1986 | Egerer | 19/97 |
| 5,031,278 | A | 7/1991 | Demuth et al. | |
| 5,054,166 | A * | 10/1991 | Demuth et al. | 19/113 |
| 5,142,741 | A | 9/1992 | Demuth et al. | |
| 5,530,994 | A * | 7/1996 | Loeffler | 19/109 |
| 6,353,974 | B1 * | 3/2002 | Graf | 19/234 |
| 6,804,863 | B1 * | 10/2004 | Henninger | 19/114 |

FOREIGN PATENT DOCUMENTS

DE 41 25 035 A1 2/1993

* cited by examiner

*Primary Examiner*—Gary L. Welch
(74) *Attorney, Agent, or Firm*—Venable LLP; Catherine M. Voorhees

(57) ABSTRACT

The present invention relates to a device, such as a carding machine, for processing fibers, said device comprising a cylinder, which is provided with a lining, and at least two carding segments which are arranged one after the other in the direction of rotation at least over an area of the circumference of said cylinder, each of said carding segments being provided with a toothed lining. The present invention aims at improving the efficiency of such a device especially in terms of fiber parallelization. In order to achieve this, the toothed linings of the carding segments are designed differently; when the fibers are engaged by the toothed lining of the carding segment constituting the upstream carding segment in the direction of rotation, the resultant influence on an individual fiber entrained by the circumference of the cylinder will be equal to or more intensive than the influence exerted when the fibers are engaged by the toothed lining of a carding segment constituting a downstream carding segment in the direction of rotation.

14 Claims, 8 Drawing Sheets

DEVICE SUCH AS A CARDING MACHINE FOR PROCESSING FIBRES

Device, such as a carding machine, for processing fibres The present invention relates to a carding machine comprising a cylinder provided with a lining, and at least two carding segments which are arranged one after the other in the direction of rotation at least over an area of the circumference of said cylinder and which are each provided with a toothed lining, toothed linings of said carding segments being designed differently.

BACKGROUND OF THE INVENTION

Such a carding machine is known e.g. from German-Offenlegungsschrift 2 226 914. The carding segments described there have different tooth densities per unit area.

Such devices serve to clean, open and parallelize raw fibres, e.g. cotton. The starting material (in the form of flocks) is supplied via an opening cylinder unit to a cylinder (e.g. a main cylinder) provided with a lining, and entrained by the circumference of said cylinder in the direction of rotation. For this purpose, the cylinder is provided with a large number of sawteeth. Normally, this toothed lining is formed by producing a sawtooth wire which is then wound onto the outer circumference of the cylinder. The tooth shapes can be designed differently for a great variety of different applications. The tips of the teeth, however, point mainly in the direction of rotation.

Carding segments are arranged at least over part of the circumference of the cylinder so that the fibres are not only entrained by the cylinder provided with a lining but also subjected to processing. Normally, a carding segment will extend over the whole width of the cylinder. The lower surface of a carding segment has an arcuate shape, whereby it is adapted to the outer circumference of the cylinder provided with a lining, and it is also equipped with a toothed lining. In many cases, the teeth are arranged in rows of teeth one behind the other and are also produced by insertion of a sawtooth wire. The tooth shape is similar to the shape of the teeth on the cylinder provided with a lining, the tips of the teeth pointing in a direction opposite to the direction of rotation of the cylinder provided with a lining. The carding segments are moved so close to the cylinder that the fibres are subjected to an opening, combing and parallelization process.

Between the carding segments, cleaning stations can be arranged, which are provided with suction means for removing dirt particles and fibre fragments. This means that the carding segments may also be arranged at a certain distance from one another. This kind of device for treating fibre material has already been known for a long time and has proved very successful. It goes without saying that, nevertheless, efforts are being made to improve these devices. In particular, attempts are made to improve the efficiency of fibre parallelization. Moreover, different fibres sometimes necessitate different processing methods.

SUMMARY OF THE INVENTION

It is therefore the object of the present invention to provide a fibre-processing device, such as a carding machine, of the type mentioned at the start, which executes more effective fibre parallelization.

According to the present invention, this object is achieved in that the teeth of the toothed linings are provided with a rake angle which, on average at least, is larger in an upstream carding segment than in a downstream carding segment so that, when the fibres are engaged by the toothed lining of the carding segment constituting the upstream carding segment in the direction of rotation, the resultant influence on an individual fibre entrained by the circumference of the cylinder will exceed the influence exerted when the fibres are engaged by the toothed lining of a carding segment constituting a downstream carding segment in the direction of rotation.

This has the effect that, in the direction of rotation of the cylinder, the engagement of the toothed linings of the carding segments with the fibres will change from more intensive at the beginning towards a kind of engagement in which careful processing of the fibres is effected. Influence or mechanical influence on an individual fibre entrained by the circumference of the cylinders means here the intensity or aggressiveness with which the respective toothed lining comes into contact with a fibre moved past the carding segments. The fibres which are supplied in the form of flocks at the beginning of the carding operation and which have not yet been opened are immediately subjected to intensive processing by the geometry of the first toothed lining, whereupon, in dependence upon the degree of opening of the fibres, the toothed linings can be adapted to said degree of opening so that the desired effect will be achieved. Surprisingly enough, the opposite course of action has always been taken in the prior art up to now. At the beginning of the carding operation, the still closed fibres were, as far as possible, subjected to processing which was less intensive than that of the fibres which had already been opened to an increasing extent. Presumably, efforts were made to subject the fibres to more intensive processing precisely at the point where they had already been opened to an increasing extent.

The decisive aspect of the present invention is that the toothed linings of the carding segments cause different processing effects from intensive to less intensive without any necessity of influencing other parameters. Due to the dependence on simple geometric connections, optimum carding segments can be provided for a great variety of different kinds of fibres in a very uncomplicated and inexpensive manner. Hence, a plurality of completely different tooth shapes can be used on one and the same device, i.e. carding machine. It turned out that, on the basis of this structural design, the fibres can be processed very effectively at comparatively high speeds and with a very good result. The present invention particularly aims at reducing the tendency of the toothed lining towards drawing fibres away from the cylinder, due to the tooth geometry, so that optimum transport of the fibres in the processing gap between the carding segment and the cylinder is effected. A sign indicating that a toothed lining is optimally adapted to the degree of opening of the fibres is a uniform wear of the processing height of the teeth.

A very simple variant for further developing the present invention is implemented such that the teeth of the toothed linings are provided with a rake angle $\alpha$ which, on average at least, is larger in an upstream carding segment than in a downstream carding segment. Depending on the respective structural design, the toothed linings are often provided with hundreds of teeth. In most cases an individual comparison between a tooth of a toothed lining of a carding segment and a tooth of a toothed lining of a subsequent carding segment would suffice, but, as far as the effect produced is concerned, it will be fully sufficient when the upstream carding segment effects, on average, a more aggressive engagement than the respective downstream carding segment. Insofar, an average rake angle $\alpha$ is taken as a reference value. When the tooth of the toothed lining is considered to be a part where the angles are described by the normal designations used in the case of a wedge shape, the rake angle $\alpha$ is defined between the cutting face, i.e. here the fibre processing face of the tooth and an imaginary line extending from the tip of the tooth to the centre of the cylinder. This means that the front carding segments act on the fibres with a more acute angle, whereas in the case of the downstream carding segments the processing faces of the teeth become increasingly steeper relative to the fibre.

Due to the change of the rake angle $\alpha$, the toothed lining of the first carding segment plucks, pulls or tugs more strongly at the fibres than the downstream carding segments. The angle $\alpha$, which becomes smaller and smaller, then has the effect that the fibres will no longer enter the toothed area of the toothed lining with the same intensity, i.e. depth. On the contrary, the tooth shape, which becomes increasingly obtuse, has the effect that the fibres will show a reduced tendency towards entering the processing area of the toothed lining of the carding segments. Experiments have shown that this will also result in a better distribution of the fibres over the entire height of the processing area of the teeth; this finds especially expression in the wear characteristics. The teeth wear substantially uniformly over the whole height of the processing zone. Neither the tip nor the root area of the processing zone are subjected to increased wear.

Another possibility of influencing the desired carding effect via the shape of the teeth is that the teeth of the toothed linings comprise an area, which is defined between the outer cutting area contour line comprising the cutting face and an imaginary connecting line intersecting the cylinder axis and the tip of the tooth at right angles and which, on average at least, is larger in an upstream carding segment than in a downstream carding segment. This means that the area below the processing face of the tooth is larger at the beginning of the carding process than in a later stage of said process so that the amount of fibres which is able to enter the processing area of the toothed lining of the carding segments will presumably be larger in the upstream carding segments than in the downstream carding segments. Assuming that all the tips of the teeth of the carding segments are spaced equally from the lining of the cylinder, the fibres will—due to the geometry of the tooth shapes of the carding segments—be forced more and more in the direction of the cylinder as the degree of opening increases. The fibres are thus, on average, transported optimally in the carding gap between the respective carding segment and the cylinder. Due to this geometrical adaptation, the influence exerted on the fibres by the teeth of the carding segment will normally be less intensive in downstream areas.

Another design measure is to be seen in that the teeth of the toothed linings have a cutting area and a root area and that the width of the root area is larger in an upstream carding segment than in a downstream carding segment. This variant can, on the one hand, be used for arranging the teeth of the various carding segments behind one another and displaced relative to one another. On the other hand, it is also possible to provide the downstream carding segment with much closer spaced teeth. These teeth can then have an appropriately smaller size so as to effect a less aggressive engagement.

Another measure for realizing the present invention can be so conceived that a tooth spacing of the teeth of the toothed linings is larger in an upstream carding segment than in a downstream carding segment. The term tooth spacing means in the present case the distance from one tip of a tooth to the next tip of a tooth in the carding direction. This means that in downstream carding segments, the teeth are arranged closer to one another.

In addition, the teeth of the toothed linings can have a height which, on average at least, is higher in an upstream carding segment than in a downstream carding segment. Also in this case, it is essentially the average height of the teeth of a toothed lining that is of importance. The lower height in the downstream carding segments automatically guarantees a less aggressive engagement, when e.g. the carding segments are adjusted such that they are located on the same level relative to the cylinder.

It is, however, also possible to maintain the overall height of the teeth in the case of all carding segments and to implement one variant such that the cutting areas of the teeth of the toothed linings have a height which, on average at least, is higher in an upstream carding segment than in a downstream carding segment. The engagement of the individual teeth will then be less intensive not because of the overall height of the teeth, but because of the lower height of the cutting areas. Hence, the tips of the teeth can be arranged at the same distance from the cylinder in all carding segments and still produce this positive effect, Another improvement of fibre parallelization and processing can be achieved in that the teeth of the toothed lining of an upstream carding segment, or rows of said teeth extending in the direction of rotation, are laterally displaced relative to the teeth of the toothed lining of the downstream carding segment, or relative to rows of said teeth extending in the direction of rotation. The teeth of a single carding segment can be arranged one after the other in a row when seen in the carding direction or direction of rotation of the cylinder. The teeth of the following carding segment should, however, be positioned such that they are displaced relative to said row so that the fibres can be processed over the whole width independently of the paths predetermined by the respective carding segments.

When the width of a tooth of the toothed lining of an upstream carding segment is divided by the width of a tooth of the toothed lining of the respective downstream carding segment the result can preferably be unequal to an integer. This will automatically guarantee that it is impossible to arrange the teeth of an upstream carding segment and a downstream carding segment such that they are disposed one behind the other. Due to the uneven division they will inevitably always be displaced relative to one another.

Another embodiment is designed in such a way that the teeth of a carding segment, which are arranged one after the other in the direction of rotation, are arranged such that they are displaced relative to one another. It is thus possible to achieve also within a single carding segment the best possible large-area processing over the whole width of the cylinder with a correspondingly enhanced parallelization effect.

In addition, dirt separation means can be arranged between at least some of said carding segments. These dirt separation means can be designed e.g. in accordance with DE 19852562. Normally, these means consist of a vertically adjustable guide strip and a subsequent separation blade which acts on the fibre at a specific angle and which removes dirt particles due to the impact effect.

According to a advantageous embodiment, suction means or a suction device are additionally provided, said suction means removing fibre fragments and dirt particles from the carding area. The prior art discloses a sufficient number of design possibilities for this kind of means.

A preferred embodiment of the present invention is implemented in such a way that in the toothed linings of the carding segments of the cover the distance between the shoulder and the tips of the teeth is smaller than the distance between the shoulder and the associated tips of the toothed lining of the main cylinder. Due to the resultant smaller passage height in the cover linings, the fibres are caused to return more rapidly from the covers to the main cylinder. At first glance this does not seem to make sense, since the more aggressive tooth engagement in the case of the first carding segments has, apparently, precisely the opposite effect, viz. that, when the fibre flocks reach the carding element, they are drawn away from the carding zone of the main cylinder into the cover and that the individual fibres are removed from the cover one after the other and parallelized. Due to the lower passage height in the cover linings this effect is maintained, but the covers are not filled with an excessive amount of fibres. This has, in total, the consequence that the dwell time of the fibres in the cover linings will be reduced, whereby the output per hour of the carding machine will, of course, be increased.

The present invention additionally relates to a carding segment for a device, such as a carding machine, for processing fibres, said carding segment being provided with a toothed lining. The carding segment is characterized by the features that the tooth geometry of the toothed lining varies in the processing direction, and that, when the fibres are engaged by an area of the toothed lining constituting an upstream area in the processing direction, the resultant influence on an individual fibre to be processed will be equal to or more intensive than the influence exerted when the fibres are engaged by an area of the toothed lining constituting a downstream area in the processing direction. By means of such a carding segment, the desired effect can also be achieved within the processing area of the carding segment itself. In this respect, it would especially be imaginable to use comparatively large carding segments which could produce the desired effect as a whole. The tooth geometry within this carding segment can change in a way corresponding to the preceding changes which take place from one carding segment to the next. Changes of the angle, the height, etc. within a single carding segment are therefore possible.

Furthermore, the present invention also relates to a method of opening, combing and parallelizing fibres by means of a cylinder provided with a lining and by means of at least two carding segments which are arranged one after the other in the direction of rotation at least over an area of the circumference of said cylinder, each of said carding segments being provided with a toothed lining. The method is characterized in that, as the degree of opening of the fibres increases, the tooth geometry of the toothed linings of the carding segments varies in dependence upon said degree of opening of the fibres so that the fibres will be in engagement with the teeth of the toothed linings of the carding segments in a substantially uniform manner over the entire height of the processing areas of said teeth. In contrast to the carding methods that have been used up to now, the method according to the present invention effects the change of the tooth geometry of the toothed linings of the carding segments as a function in dependence upon the degree of opening of the fibres and in dependence upon the wear occurring at the toothed linings. This will in particular also have the effect that the fibres are optimally conveyed and processed in the processing gap between the carding segments and the cylinder. Experiments have shown that very good results can be achieved in this way and that the wear characteristics can be improved. The question why the opposite course of action has always been adopted in the prior art up to now and why the fibres have been processed such that the influence thereon and the processing aggressiveness increased as the degree of opening increased, can, retrospectively, only be answered by assuming that a misinterpretation existed quite obviously.

BRIEF DESCRIPTION OF THE DRAWINGS

In the following, embodiments of the present invention will be explained in detail making reference to a drawing, in which.

DETAILED DESCRIPTION OF THE INVENTION

Figure 1:
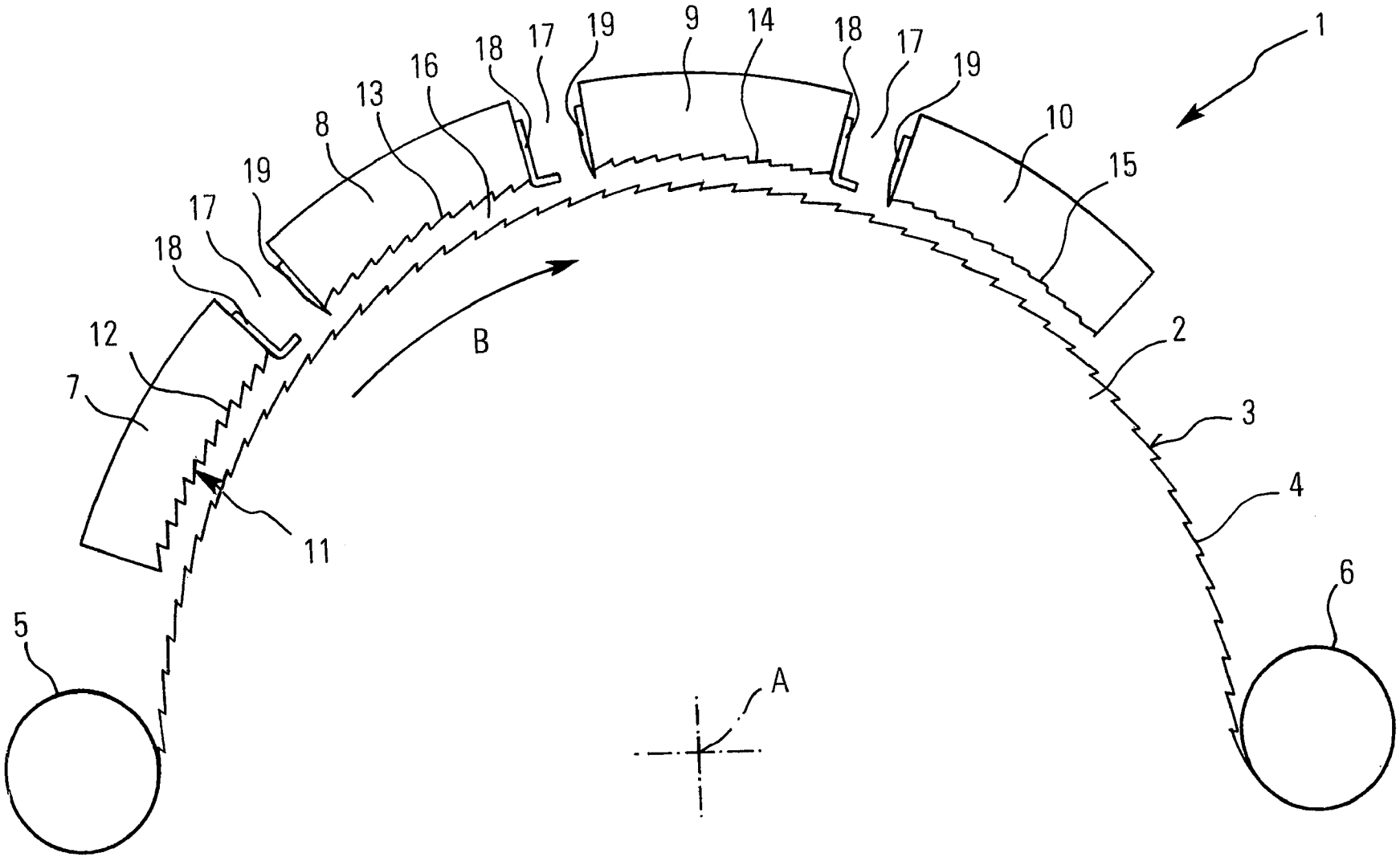
FIG. 1 shows, in a schematic side view, a carding device provided with a plurality of carding segments which are arranged one after the other.

FIG. 1 shows a schematic representation of a carding device 1 in a plane perpendicular to an axis of rotation A of a carding cylinder or main cylinder 2. The circumferential surface 3 of the main cylinder 2 is provided with a lining 4 for processing fibre material. The lining 4 consists of a wound-on toothed wire, the individual tips of said teeth pointing in the direction of rotation and carding direction B. The structural design of such linings 4 is known very well in the prior art and will not be described in detail in the present connection. From arrow B it can be seen that the main cylinder 2 rotates clockwise. On the left hand side, an opening cylinder 5 is schematically shown, said opening cylinder 5 supplying the fibres to the main cylinder 2. Also for this purpose, known opening cylinder devices can be used. The prior art discloses a sufficient number of examples. On the opposite side, a doffer cylinder 6 is provided; this doffer cylinder 6 schematically represents the doffer device which removes the carded fibres from the main cylinder 2 and carries them off for further processing. Also as far as these doffer devices 6 are concerned, the prior art discloses a sufficient number of examples which need not be discussed in detail.

On the outer circumference, at least in the upper area thereof (in the portion between the opening cylinder 5 and the doffer cylinder 6), a plurality of fixed carding segments 7 to 10 is provided, the carding segments being arranged one after the other. Each of these carding segments 7 to 10 is arranged at a certain distance above the circumferential surface 3 of the main cylinder 2. In addition, the segments are also adapted to the contour of the main cylinder 2 and have therefore an arcuate shape, the lower surfaces of said segments being arranged always at the same distance from said circumferential surface 3 as far as possible. These carding segments 7 to 10 are provided with toothed linings 12 to 15 on the lower surfaces 11 thereof. Similar to the lining 4 of the main cylinder 2, these toothed linings consist of juxtaposed toothed wire sections. The fundamental structural design and arrangement of such linings on carding elements is also known in the prior art.

The device according to FIG. 1 is essentially new and inventive insofar as the toothed linings 12 to 15 process the fibres with decreasing aggressiveness in the sequence mentioned here. In the present case, this means that four different steps of aggressiveness exist. It would, of course, also be possible that two successively arranged carding segments process the fibres with the same aggressiveness and that the subsequent carding segments are then, in turn, less aggressive. Moreover, only the carding segments 7 to 10 are shown in this variant in order to make things easier. Normally, it would be possible to arrange also other processing devices on the circumference of the main cylinder 2. In particular when the opening cylinder 5 and the doffer cylinder 6 are arranged further down on the circumference of the main cylinder 2, a larger operating area will be available, which permits further carding segments or other processing devices to be arranged in addition.

Every carding segment 7 to 10 can be regarded as a kind of cover piece, which is arranged such that it hovers over the main cylinder 2 at a small distance therefrom and which, in contrast to the main cylinder 2, stands still. It follows that a processing gap 16 for carding the fibres, which are not shown, exists between the toothed lining 4 of the main cylinder 2 and the toothed linings 12 to 15 of the carding segments 7 to 10.

Each of the respective carding segments 7 to 10 have provided between them a separation channel 17 for removing dirt and fibre fragments. At the end of the respective carding segments 7, 8 and 9 an L-shaped, striplike hold-down device 18 is provided by means of which the fibres emerging from the processing gap 16 are slightly pressed down so that, subsequently, they will expand outwards in an explosion like movement and come into contact with a separation blade 19. The separation blade 19 may occupy a great variety of angular positions so that the separation can be executed with different cutting angles. The height of the separation blade 19 above the toothed lining of the main cylinder 2 can be adjusted as well, and it is also possible to adjust the height of the hold-down device 18 in accordance with the main cylinder 2 for varying the distance. The dirt particles and the fibre fragments are then discharged through the gap between the hold-down device 18 and the separation blade 19. A separate suction device can be arranged above each separation channel 17. It is, however, definitely also possible to arrange a suction hood over the whole unit. The prior art discloses, also in this respect, various design possibilities which can be used for these purposes.

In the following, the geometry of the teeth of the carding segments 7 to 10 will now be explained in detail making reference to FIGS. 2 and 3.

Figure 2:
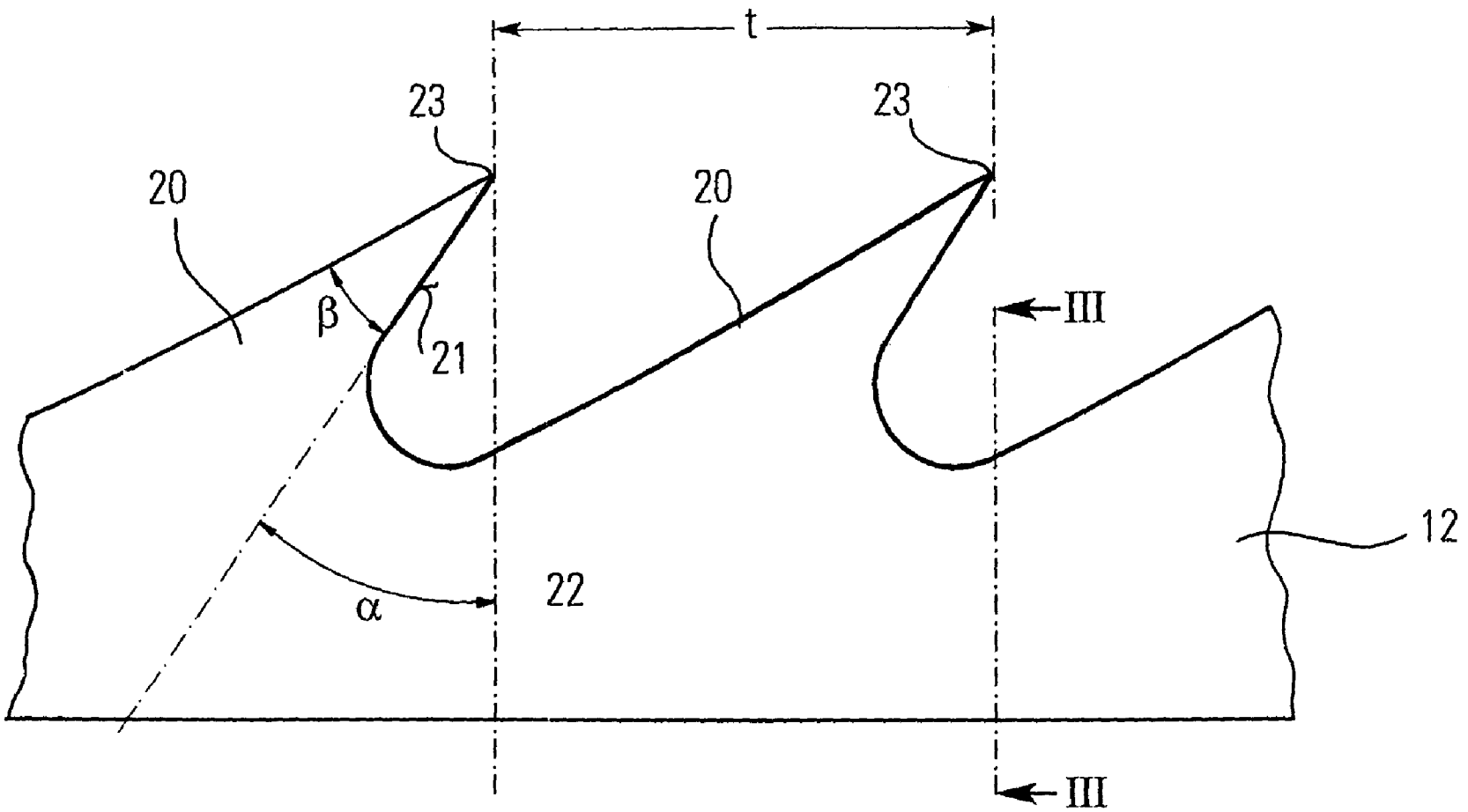
FIG. 2 shows a detail from a toothed lining of a carding segment in an enlarged side view.

FIG. 2 shows an enlarged representation of a small detail of the toothed lining of the carding segment 7. The toothed lining 12 has been turned upside down for this purpose. For the sake of simplicity, only one row of teeth is shown. The individual teeth 20 of the toothed lining 12 are produced from a common steel wire, at least as long as said teeth are arranged in one row. In the prior art, a great variety of such carding teeth as well as a great variety of production methods are known. All of them should be applicable in the present case. In FIG. 2, teeth 20 in the form of a sawtooth profile are shown. For the sake of simplicity, the designations of angles and the angular relationships, which are normally used in the case of cutting tools, will also be used in the present context for describing the toothed lining 12.

Accordingly, each tooth 20 has a wedge angle $\beta$ and a rake angle $\alpha$. The rake angle $\alpha$ is defined between a tangent on the cutting or processing face 21 and a line 22 whose course is defined by the shortest connection between the tip 23 of the tooth and the axis A of the main cylinder 2. These are, of course, the conditions existing when the carding segment 7 has been installed. The wedge angle $\beta$ is normally smaller than 45° so that the resultant teeth 20 are comparatively pointed. The distance t between a tip 23 of a tooth to the next tip 23 of another tooth of a row of teeth is referred to as tooth spacing in the present case. In most cases, hundreds of said teeth 20 are attached to the lower surface 11 of a carding element 7 to 10.

Figure 3:
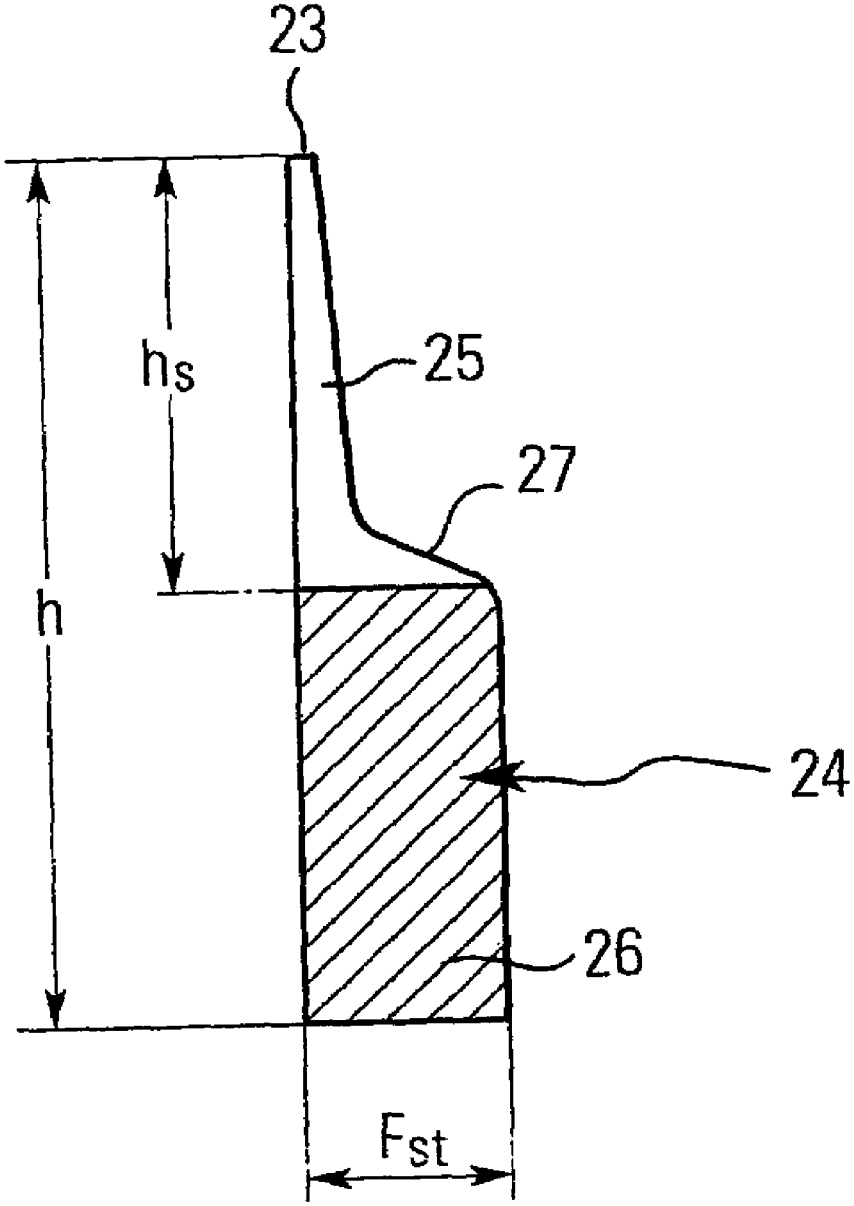
FIG. 3 shows a view of a tooth of the lining according to FIG. 2 cut along the line III—III in FIG. 2.

FIG. 3 shows a section along line III—III in FIG. 2 through a toothed wire 24. In the present case, the whole structure shown in FIG. 3 and having the height h is considered to be a tooth 20. This tooth 20 is subdivided into an upper cutting area 25 having the height $h_s$ and a lower root area 26. The root area 26 is broader than the cutting area 25 so that, when toothed wires 24 are arranged side by side, the cutting areas 25 will be laterally spaced from one another. The cutting area 25 extends along one side of the toothed wire 24 up to the tip 23 of the tooth and merges essentially smoothly with the root area 26, whereas on the other side the transition to the root area 26 takes place in the form of a step 27. The root area 26 has a width $F_{st}$. This root width $F_{st}$ provides, in the final analysis, also the distance between the cutting areas 25 of a toothed lining. The root area 26 serves to firmly secure the toothed wires to the lower surface of the carding segments 7 to 10.

From the schematic representation according to FIG. 1, it can be seen that the angle $\alpha$ of carding segment 7 is larger than that of carding segment 8, and that the angle $\alpha$ of carding segment 8 is larger that of carding segment 9 as well as that the angle $\alpha$ of carding segment 9 is larger than that of carding segment 10. This means that the processing face 21 of the tooth 20 approaches the imaginary connecting line 22 more and more. In this context, larger means not only the magnitude but also negative signs so that, according to the definition of FIG. 2, negative angular values also have to be regarded as smaller angles.

In addition, also the tooth spacing t decreases from one carding segment to the next in direction B. This means that the tooth spacing t of carding segment 7 is larger than that of carding segment 8, and that the tooth spacing t of carding segment 8 is larger that of carding segment 9 as well as that the tooth spacing t of carding segment 9 is larger than that of carding segment 10. It follows that the distance between the teeth 20 decreases from one carding segment to the next.

Furthermore, also the height $h_s$ of the cutting area 25 decreases in the carding direction B from one carding segment to the next. This means in detail that the height $h_s$ in the case of carding segment 7 is higher than that in the case of carding segment 8, that the height $h_s$ in the case of carding segment 8 is higher than that in the case of carding segment 9, and that the height $h_s$ in the case of carding segment 9 is higher than that in the case of carding segment 10. This also has the effect that the overall height h of the teeth 20 decreases from one carding segment to the next.

In an embodiment, which is not shown, it would also be possible to maintain the overall height h and to reduce only the height $h_s$ of the cutting area 25.

The above-mentioned reductions of the dimensions for the angle α, the tooth spacing t, the root width $F_{st}$ and the cutting area height $h_s$ are, related to the respective carding segments 7 to 10, averaged values. The aim to be achieved by these reductions is that the aggressiveness with which the fibres are processed decreases from one carding segment to the next. Hence, carding segment 7 works more aggressively than carding segment 8, carding segment 8 works more aggressively than carding segment 9 and carding segment 9 works more aggressively than carding segment 10. Aggressiveness means here the intensity with the fibres are acted upon by the carding segments. Preferably, all these measures are used in combination. It is, however, definitely also possible to change only one of these dimensions.

Figure 4:
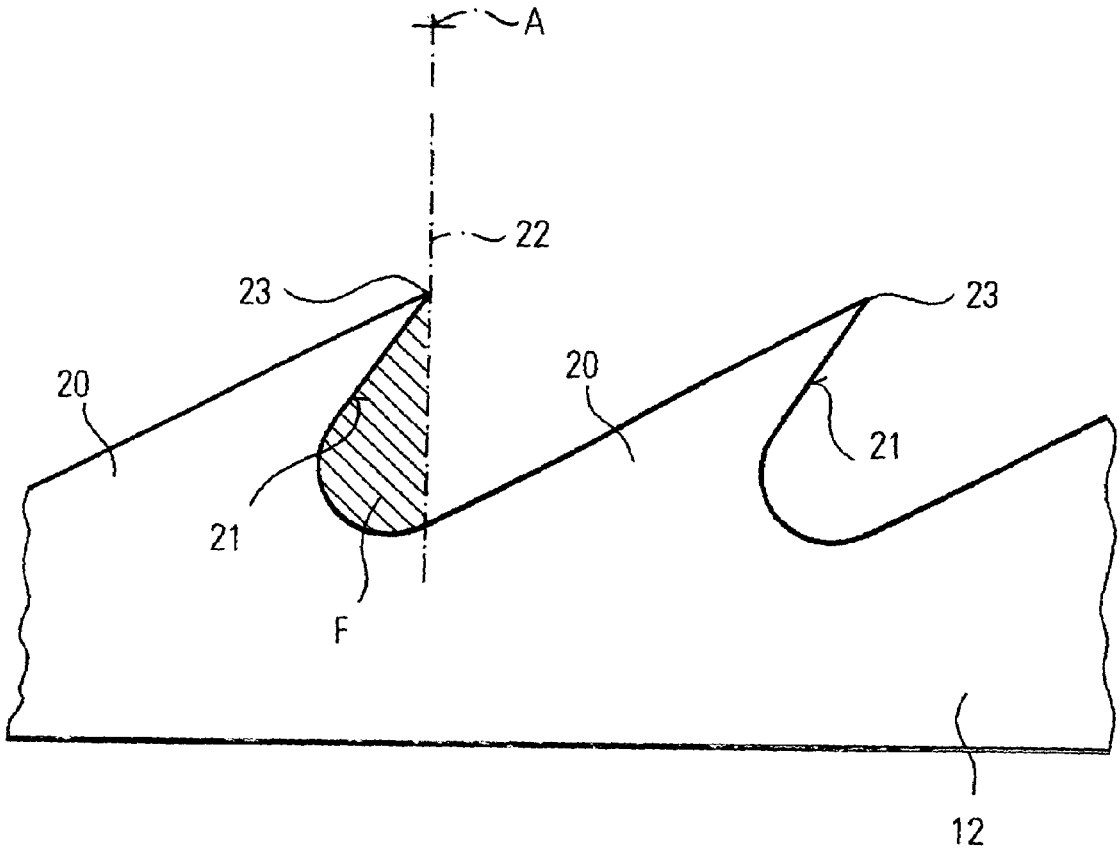
FIG. 4 shows a detail from a toothed lining of a carding segment in an enlarged side view for explaining the relationship between respective areas.

On the basis of FIG. 4, it is explained that, when seen in a side view, the processing face 21 spans a contour line, which starts at the tip 23 of the tooth and which is concave in the root area of the tooth 20. An imaginary connecting line 22, which intersects the axis A of the cylinder at right angles and which extends precisely through the tip 23 of the tooth 20, encloses in the area of its extension together with the contour line of the tooth 20 an area F. This area F can be determined for each tooth of the toothed linings 12, 13, 14 and 15. If the angle α is changed and also if other parameters are changed according to the teaching of the present invention, this area F will always be smaller in the case of a subsequent carding segment than in the case of a preceding carding segment. In this connection, an averaged size of the area F per carding segment 7, 8, 9 or 10 can again be taken as a reference value. When the thickness of the teeth 20 is included in these considerations as well, also the volume below the processing face 21 will become smaller so that, when the size of the area F decreases, the number of fibres which can be accommodated in this region will be reduced. With fibres that become more and more open, this will lead to a more uniform distribution along the processing face 21 and to a more uniform wear.

In the following, the mode of operation of the above embodiment will be explained in detail.

Fibres are supplied to the main cylinder 2 via the opening cylinder 5 and entrained by the toothed lining 4 on the circumferential surface 3 of said main cylinder 2 in the direction of rotation B. When the fibres enter the gap 16 between the carding segment 7 and the main cylinder 2, a combing operation for parallelizing the fibres takes place. This is done due to the fact that the tooth tips 23 of the toothed lining 12 of the carding segment 7 point in a direction opposite to the direction of the toothed lining 4 of the main cylinder 2. Due to the subsequent separation of dirt in the separation channel 17, first fibre fragments and dirt particles are removed.

Subsequently, the fibre material additionally passes through the working gaps 16 defined between the respective carding segments 8, 9, 10 and the main cylinder 2, the fibres being carded and parallelized in the respective working gaps with decreasing intensity. The intensity decreases due to the above-described structural design of the toothed linings 12 to 15 on the carding segments 7 to 10. Subsequently, the parallelized and entrained fibres are removed from the main cylinder 2 via the doffer cylinder 6 and carried away for further processing.

Figure 6:
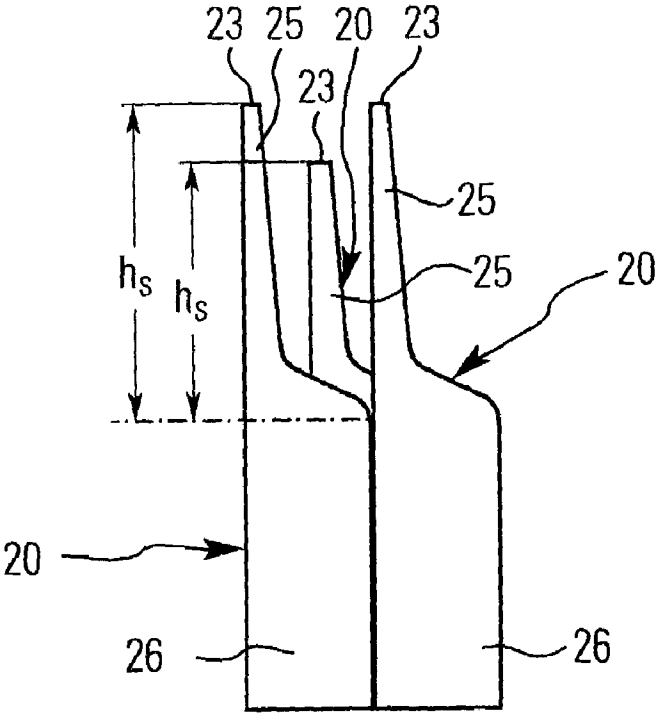
FIG. 6 shows a schematic representation for illustrating the displacement between the teeth of an upstream carding segment and those of a downstream carding segment.
Figure 5:
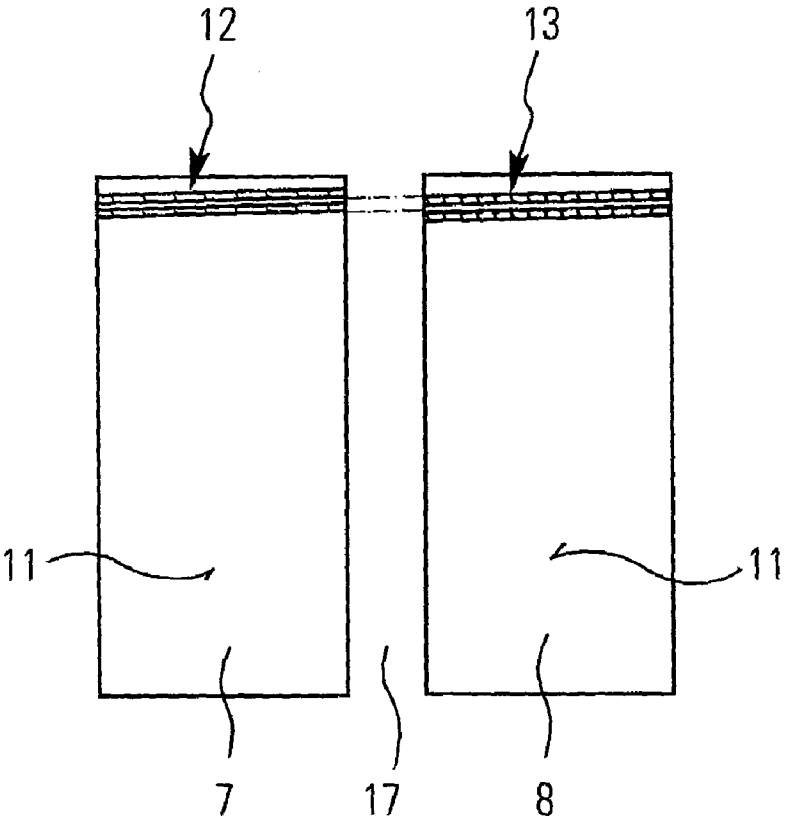
FIG. 5 shows the lower surfaces of two successively arranged carding segments, only part of the toothed lining being shown schematically.
Figure 7:
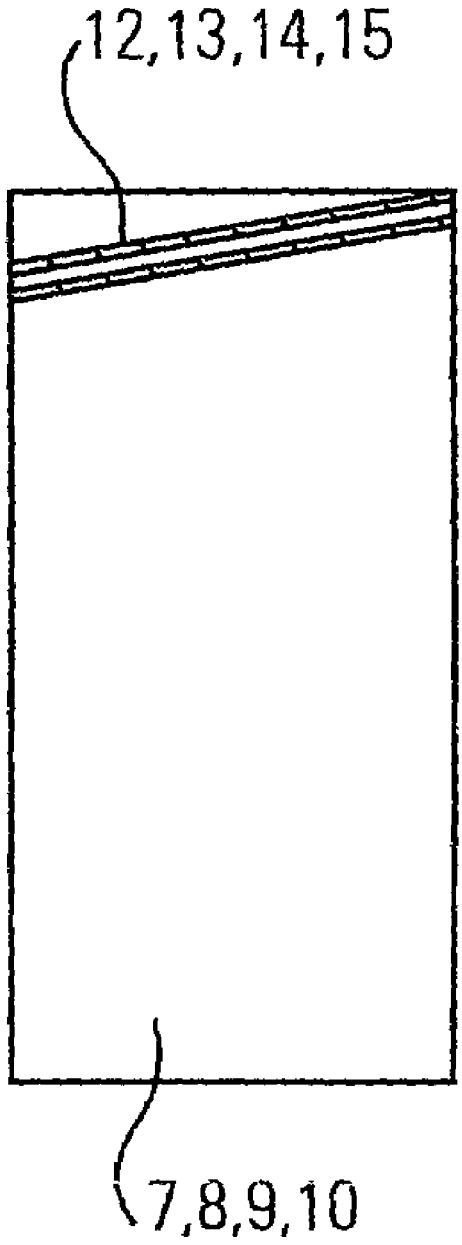
FIG. 7 shows a schematic representation of the lower surface of a carding segment having rows of teeth which extend at an oblique angle.

Making reference to FIGS. 5 to 7, further embodiments of the carding segments are explained in detail.

In FIG. 5 the lower surfaces of two successively arranged carding segments 7 and 8 are shown. For the sake of simplicity, only a part of the toothed linings 12 and 13 is shown. In the present case, toothed wires comprising a plurality of teeth 20 are used, said teeth 20 extending substantially parallel to a plane intersecting the axis A at right angles. According to the representation shown in FIG. 5, the tips of the teeth 20 point to the left. The rows of teeth of carding segment 7 are arranged such that they are displaced relative to the rows of teeth of carding segment 8. This is shown on the basis of FIG. 6 by means of a schematic front view of the teeth. The two front teeth 20 symbolize two juxtaposed rows of teeth of the carding segment 7 and the tooth 20 lying between and behind these front teeth symbolizes a row of teeth of the carding segment 8 located therebehind. It can easily be seen that the cutting areas of these teeth 20 are displaced relative to one another so that also different areas of the fibres will be processed by the carding segments 7 and 8. This displacement can also be achieved in that the root width $F_t$ of the preceding carding segment 7 divided by the root width $F_t$ of the following carding segment 8 does not result in an integer ($F_{stn}/F_{stn+1} \neq$ integer). FIG. 5 also shows that the height $h_s$ of the cutting area 25 of the teeth of the rear carding segment 8 is smaller than the height $h_s$ of the teeth 20 of the carding segment 7 arranged in front of said carding segment 8.

FIG. 7 shows a further embodiment of a carding segment. In this embodiment the rows of teeth of the toothed linings are arranged at an oblique angle so that processing within a carding segment 7 to 10 will automatically extend over the whole width of the main cylinder 2. An orientation relative to a subsequent carding segment 8, 9 or 10 is not absolutely necessary.

Also in the case of the variants according to FIGS. 5 to 7, all the dimensions described in the first embodiment can be changed so as to influence the intensity of the carding effect from one carding segment to the next.

Figure 8:
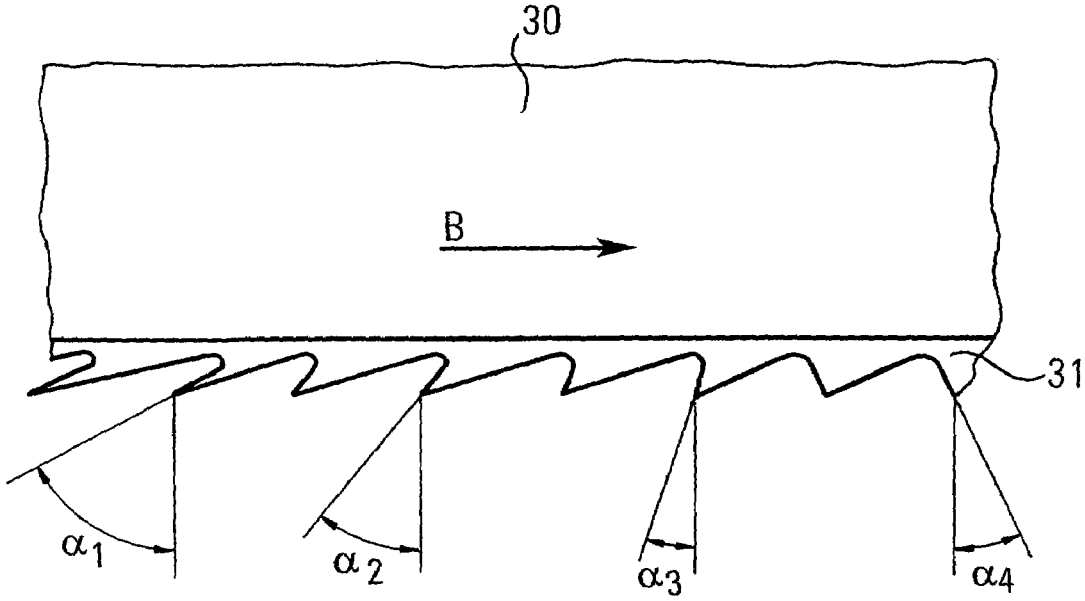
FIG. 8 shows a schematic representation of the toothed lining of an individual carding segment, said toothed lining changing in the direction of processing.

In FIG. 8 a special embodiment of a carding segment 30 is described. This carding segment 30 is provided with a toothed lining 31 which changes in the direction of processing B. In FIG. 8 it is schematically shown that the teeth 20 representing the front teeth in the direction of processing have a rake angle α1 which is larger than that of the following teeth. The rake angle α1 is therefore larger than the rake angle α2, and the rake angle α2 is larger than the rake angle α3. In view of the fact that the rake angle α4 is negative, also the rake angle α3 is larger than the rake angle α4. FIG. 8 only shows a schematic representation, and, consequently, the variation of the tooth shape could also take place over a larger area and less rapidly. Also all the other changes of tooth geometry for achieving the same effect could be carried out in such a carding segment 30 similar to the above-described changes. However, the best results can presumably be achieved by changing the respective angles. It would definitely be imaginable to arrange a single carding segment 30 having this kind of structural design on a cylinder 4.

Figure 9:
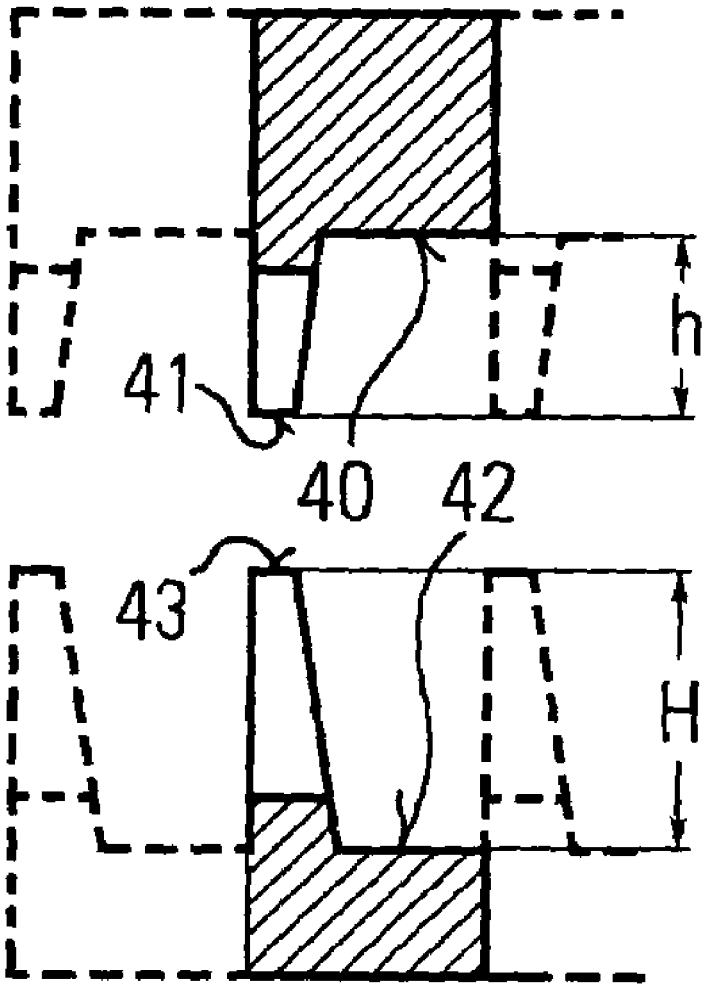
FIG. 9 shows, in a schematic representation, a sectional view through a sawtooth wire of the main cylinder lining with a saw tooth wire of a cover lining arranged above said main cylinder lining.

From FIG. 9 it can be seen that in the toothed linings of the carding segments the distance h between the shoulder 40 and the associated tips 41 of the teeth is chosen such that it is smaller than the distance H between the shoulder 42 and the associated tips 43 of the teeth of the toothed lining of the main cylinder. The resultant smaller passage height h formed in the covers has the effect that, in spite of the cutting edges which act more aggressively on the fibres in the case of the first carding segments and which draw the fibre bundles from the carding zone between the tips of the teeth into the passages of the cover, the fibre volume contained in the covers is kept small and that, in addition, also the dwell time of the fibres in the carding segments of the cover is reduced.

What is claimed is:

1. A carding machine comprising a cylinder provided with a lining, and at least two carding segments which are arranged one after the other in the direction of rotation at least over an area of the circumference of said cylinder and which are each provided with a toothed lining, said toothed linings of said carding segments being designed differently, characterized in that the teeth of the toothed linings are provided with a rake angle which, on average at least, is larger in an upstream carding segment than in a downstream carding segment so that, when the fibres are engaged by the toothed lining of the carding segment constituting the upstream carding segment in the direction of rotation, the resultant influence on an individual fibre entrained by the circumference of the cylinder will exceed the influence exerted when the fibres are engaged by the toothed lining of a carding segment constituting a downstream carding segment in the direction of rotation.

2. A device according to claim 1, characterized in that the teeth of the toothed linings comprise an area, which is defined between the outer cutting area contour line comprising the cutting face and an imaginary connecting line intersecting the cylinder axis and the tip of the tooth at right angles and which, on average at least, is larger in an upstream carding segment than in a downstream carding segment.

3. A device according to claim 1, characterized in that the teeth of the toothed linings have a cutting area and a root area and that the width of the root area is larger in an upstream carding segment than in a downstream carding segment.

4. A device according to claim 1, characterized in That a tooth spacing of the teeth of the toothed linings is larger in an upstream carding segment than In a downstream carding segment.

5. A device according to claim 1, characterized in that the teeth of the toothed linings have a height which, on average at least, is higher in an upstream carding segment than in a downstream carding segment.

6. A device according to claim 1, characterized in that the cutting areas of the teeth of the toothed linings have a height which, on average at least, is higher in an upstream carding segment than in a downstream carding segment.

7. A device according to claim 1, characterized in that the teeth of the toothed linings of an upstream carding segment are laterally displaced relative to the teeth of the toothed linings of the downstream carding segment.

8. A device according to claim 7, characterized in that when the width of a tooth of the toothed lining of an upstream carding segment is divided by the width of a tooth of the toothed lining of the respective downstream carding segment, the result is not equal to an integer.

9. A device according to claim 1, characterized in that the teeth of a carding segment, which are arranged one after the other in the direction of rotation, are arranged such that they are displaced relative to one another.

10. A device according to claim 1, characterized in that a dirt separator is arranged between at least some of said carding segments.

11. A device according to claim 1, characterized in that a suction device is provided.

12. A device according to claim 1, characterized in that in the toothed linings of the carding segments the distance between the shoulder, which fills the space between two rows of teeth, and the associated tips of the teeth is smaller than the distance between the shoulder and the associated tips of the cylinder provided with a lining.

13. A carding segment for a device, such as a carding machine, for processing fibres, which is provided with a toothed lining, characterized in that the tooth geometry of the toothed lining varies in the processing direction, and that, when the fibres are engaged by an area of the toothed lining constituting an upstream area in the processing direction, the resultant influence on an individual fibre to be processed will be at least equal to the influence exerted when the fibres are engaged by an area of the toothed lining constituting a downstream area in the processing direction.

14. A method of opening, combing and parallelizing fibres by means of a cylinder provided with a lining and by means of at least two carding segments which are arranged one after the other in the direction of rotation at least over an area of the circumference of said cylinder, each of said carding segments being provided with a toothed lining, characterized in that, as the degree of opening of the fibres increases, the tooth geometry of the toothed linings of the carding segments varies in dependence upon the degree of opening of said fibres so that the fibres will be in engagement with the teeth of the toothed linings of the carding segments in a substantially uniform manner over the entire height of the processing areas of said teeth.

* * * * *